US005584445A

United States Patent [19]

Kremar

[11] Patent Number: 5,584,445

[45] Date of Patent: Dec. 17, 1996

[54] CENTER WIND ASSIST MECHANISM IN SECONDARY POSITION

[76] Inventor: Djuro Kremar, #31 - 40th Ave., Notre Dame Ile Perrot Quebec, Canada, J7V 5X8

[21] Appl. No.: 404,275

[22] Filed: Mar. 14, 1995

[30] Foreign Application Priority Data

Jan. 26, 1995 [CA] Canada ..... 2141130

[51] Int. Cl.[6] ..... B65H 18/14; B65H 18/26

[52] U.S. Cl. ..... 242/541.1; 242/546

[58] Field of Search ..... 242/541.1, 541.7, 242/546, 542.3

[56] References Cited

U.S. PATENT DOCUMENTS

| | | | |
|---|---|---|---|
| 2,865,264 | 12/1958 | Moser | 93/58.2 |
| 3,086,403 | 4/1963 | Knerr et al. | 74/242.9 |
| 4,358,066 | 11/1982 | Deutsche et al. | 242/68.4 |
| 4,445,646 | 5/1984 | Karr et al. | 242/56 R |
| 4,497,455 | 2/1985 | Kampf et al. | 242/56.9 |
| 4,532,750 | 8/1985 | Meier | 53/118 |
| 4,634,068 | 1/1987 | Malkki et al. | 242/65 |
| 4,634,069 | 1/1987 | Kataska | 242/541.1 X |
| 5,064,131 | 11/1991 | van Biesen et al. | 242/65 |
| 5,069,394 | 12/1991 | Pauttila et al. | 242/67.1 R |
| 5,083,719 | 1/1992 | Kremar | 242/66 |

*Primary Examiner*—John Q. Nguyen

[57] ABSTRACT

A center wind assist mechanism is provided for use in a web winding device for winding a substantially continuous web onto a reel bar rotating about its center axis. The winding device incudes a driving drum that maintains a first nip engagement with the reel bar to rotate the reel bar and transfer the web passing over a surface of the driving drum onto the reel bar. The winding device also includes a secondary arm for engaging the reel bar to maintain the reel bar in nip driving engagement with the driving drum. The center wind assist mechanism comprises a drive assist support arm mounted to the secondary arm to move therewith. The center wind assist mechanism also includes a driving wheel rotatably connected to one end of the drive assist support arm. The center wind assist mechanism further includes tensioning apparatus, a center assist drive and transmission. The tensioning apparatus is connected to the drive assist support arm to maintain the driving wheel in driving and torque transfer relation with a peripheral surface portion of the reel bar which peripheral surface portion is off center to the center axis of the reel bar between the center axis and the driving drum. The center assist drive rotatably drives through a transmission the driving wheel. The use of the center assist drive mechanism insures that a driving assist is provided by the driving wheel. Further, the location of the driving wheel in the off center location does not add to the nip pressure being applied by the secondary arm which could adversely effect the web being wound onto the reel bar.

11 Claims, 2 Drawing Sheets

CENTER WIND ASSIST MECHANISM IN SECONDARY POSITION

FIELD OF THE INVENTION

The present invention relates to a center wind assist winding mechanism for use in a web winding device of a paper making machine wherein a continuous web of paper may be wound onto a reel bar.

BACKGROUND OF THE INVENTION

Paper-making typically involves forming, pressing, drying and reeling of a paper web passing through the paper machine. Current day paper-making machines operate at high speed and reel bars provided in the winding section of the machine must maintain an uninterrupted winding of the web onto the reel bar.

The reel bar contacts in nip engagement a driving drum and is driven by this engagement so that the paper web passing in contact with the driving drum is wound onto the reel bar. The reel bar usually is supported on rails during the reeling operation. Tension is provided to the web by running the driving drum faster than the speed of the previous section of the paper-making machine. The tension and nip pressure can be varied to produce rolls of paper with a desired tightness.

This form of winding with the driving drum contacting the reel bar has a tendency to have an uneven nip pressure over the width of the web. This is usually due to roll deflection. Roll deflection effects the tension of the web wound onto the reel bar and is more severe when the web being reeled is recycled. With environmental concerns, an increased usage of recycled paper has occurred. Recycled paper includes a wide variety of paper products and the incorporation of recycled fiber in newsprint and other paper furnishes.

Accordingly, it is believed that the use of center assist mechanism in the reeling/winding operation will result in a more even winding tension to the reel bar. While center assist winding is known in the art, it is believed that the center assist winding device of the present invention provides a novel structure that results in an even tension being provided to the web wound onto the reel bar.

SUMMARY OF THE INVENTION

In accordance with one aspect of the present invention there is provided a center wind assist mechanism for use in a web winding device for winding a substantially continuous web onto a reel bar rotating about its center axis. The winding device incudes a driving drum that maintains a first nip engagement with the reel bar to rotate the reel bar and transfer the web passing over a surface of the driving drum onto the reel bar. The winding device also includes a secondary arm for engaging the reel bar to maintain the reel bar in nip driving engagement with the driving drum. The secondary arm is pivotally movable about its base to move and maintain the nip driving engagement as the web is wound onto the reel bar. The center wind assist mechanism comprises a drive assist support arm mounted to the secondary arm to move therewith. The center wind assist mechanism also includes a driving wheel rotatably connected to one end of the drive assist support arm. The center wind assist mechanism further includes tensioning means, and center assist drive means. The tensioning means is connected to the drive assist support arm to maintain the driving wheel in driving and torque transfer relation with a peripheral surface portion of the reel bar which peripheral surface portion is located adjacent to a vertical line passing through the center axis of the reel bar on a side of the vertical line closest to the driving drum. The center assist drive means rotatably drives the driving wheel.

The use of this novel center assist drive mechanism insures that a driving assist is provided by the driving wheel to one side of the vertical line or. Further, the location of the driving wheel in the off center location does not add to the nip pressure being applied by the secondary arm which could adversely effect the web being wound onto the reel bar.

In accordance with a preferred aspect of the present invention, the drive assist support arm preferably has a base end remote from the one end to which the driving wheel is rotatably attached. The base end is pivotally connected about an axis axially aligned with the pivotal axis of the secondary arm. The drive assist support arm further includes an intermediate location between the base and the one end which is connected to the secondary arm such that the drive assist support arm pivots about its axis as the secondary arm pivots about its axis as the web is wound onto the reel bar. Preferably, the drive assist support arm includes a pin at the intermediate location that fits into a recess on the secondary arm. The drive assist support arm is curved such that the drive assist support arm extends from the base in a direction parallel to the secondary arm and then curves at an angle to position the driving wheel from beneath the reel bar. The drive assist arm may include two linkage arms pivotally connected to each other at an intermediate point. The drive assist support arm is connected with the secondary arm at the intermediate point such that the drive assist support arm pivots about the shaft as the secondary arm pivots about the shaft as the web is wound onto the reel bar.

Preferably, the tensioning means of the center assist winding mechanism includes piston and cylinder means pivotally interconnecting the base of the drive assist support arm at the bottom of the first linkage arm to the one end of the drive assist support arm rotatably supporting the driving wheel. The drive means of the center assist mechanism includes an electric motor that is shaft coupled to a transmission means, the transmission means includes a first belt passing about the motor shaft and a first pulley at the intermediate point. The transmission means includes a second belt passing about the first pulley at the intermediate point and a second pulley that is shaft coupled to the driving wheel to rotate the driving wheel.

BRIEF DESCRIPTION OF THE DRAWINGS

The invention will be better understood and its numerous objects and advantages will become more apparent to those skilled in the art by reference to the following drawings, in conjunction with the accompanying specification, in which.

DETAILED DESCRIPTION OF EMBODIMENTS

Figure 1:
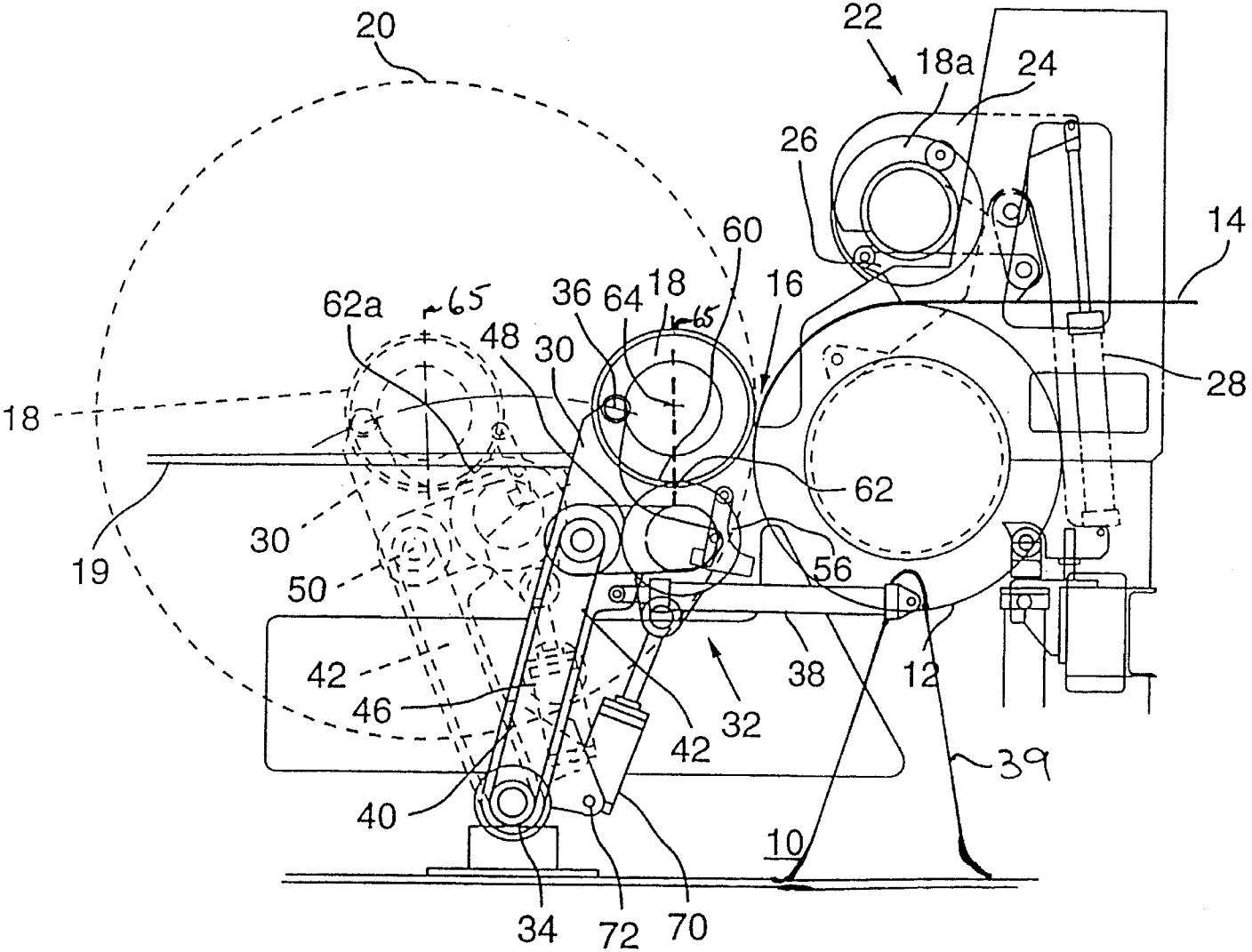
FIG. 1 is end view of the web winding device of the present invention incorporating a center assist winding device.

Referring to FIG. 1 there is shown a web winding or reeling device generally at 10. The winding device includes a driving drum 12 which has a continuous web 14 passing thereover. Driving drum 12 forms a nipped contact at point 16 shown between the reel bar 18 and the drum 12. The reel bar 18 is shown in solid lines at the beginning of its secondary winding position. As the web 14 is wound onto the reel bar 18, the reel center portion moves to the left supported along rails 19 as shown in broken reel 18. The web will be wound to a diameter as shown by broken line 20.

Prior to the reel bar 18 entering the secondary winding position shown adjacent arrow 16, a reel bar must first be lowered into driving contact relation with the drum means 12. The lowering of the reel bar is represented by reel bar 18*a* shown to the upper right hand corner of FIG. 1. Reel bar 18*a* is held in place by a clamping arrangement 22 comprising an upper clamp arm 24 and a lower co-operating jaw 26. During the reeling operation, to allow the paper web to be continuously wound onto a reel, the reel 18*a* is first started by a starter drive and brought up to speed (not shown). Once reel 18*a* reaches this pre-determined rotational speed, the lower co-operating jaw 26 is lowered allowing the peripheral surface of the reel bar 18*a* to come into contact with the peripheral surface of drum 12. At this time, the paper web 14 is cut and starts to wind onto the new reel bar 18*a* at the primary winding position. This allows the fully wound reel 18 to be slowed down and removed from the rails 19. Referring back to reel 18*a*, the piston cylinder mechanism 28 expands allowing the clamp jaw 24 to hold the reel 18*a* in nip engagement with the drum 12 as the reel 18*a* moves from its primary winding position to the secondary winding position shown by reel 18 adjacent arrow 16. Once the reel moves to its secondary winding position, the secondary arm 30 of the winding device moves into contact the peripheral surface of the reel hub forcing the reel 18 to maintain its contact nip engagement at 16. It should be understood that reel 18 is now supported by rails 19. At this time, the upper jaw assembly 22 is removed and returns to its upper position to accept a new reel to loaded.

Figure 2:
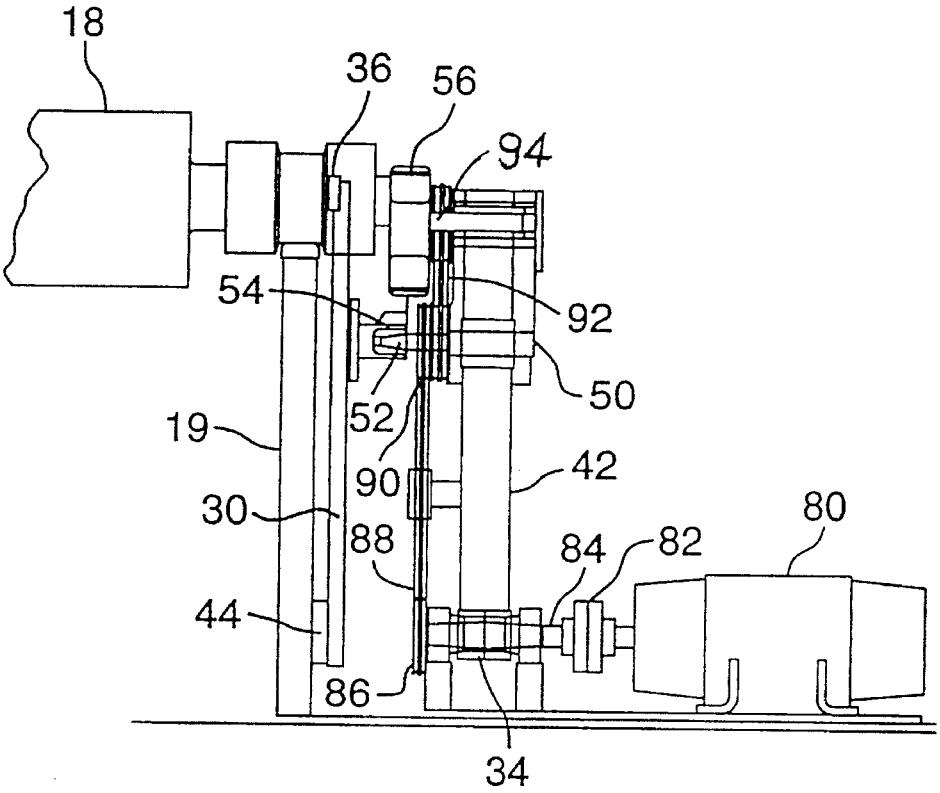
FIG. 2 is a front elevational view of the web winding device of FIG. 1 and, FIG. 3 is a rear elevational view of the web winding device of FIG. 1.
Figure 3:
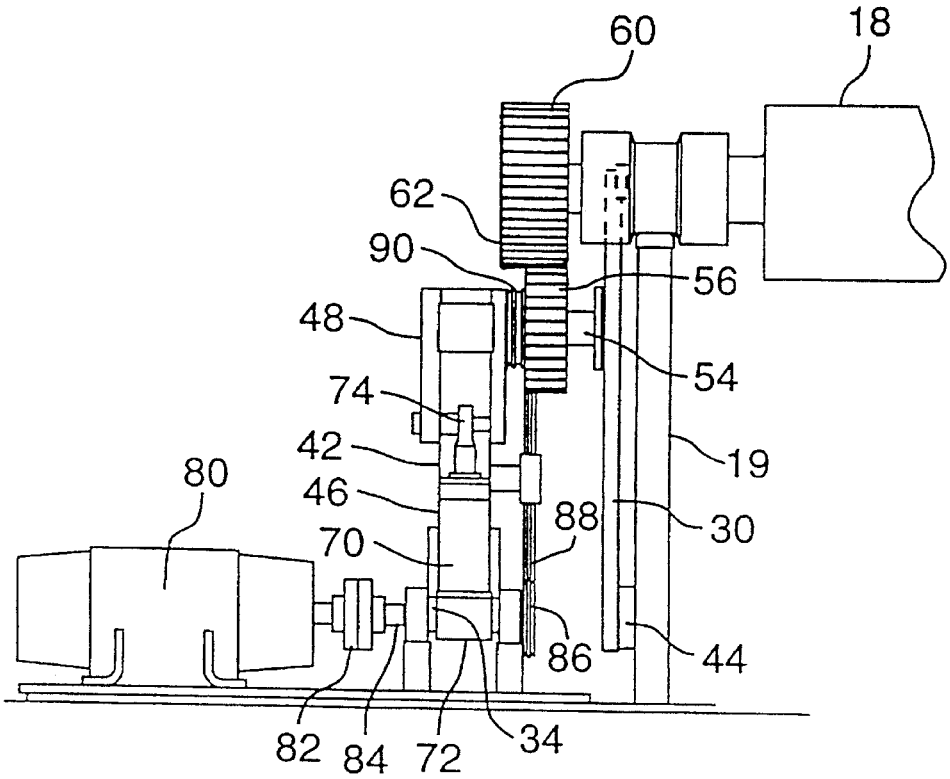

The present invention is directed primary towards the center assist drive mechanism shown generally by arrow 32 in the drawings. It can be seen that the secondary arm 30 moves to the right pivotally about a shaft 44 (see FIGS. 2 and 3) as the reel is wound with paper web 20. The secondary arm 30 further includes a cam 36 which is rotatable and engages the hub surface of the reel bar 18 to maintain the nip pressure at nip 16. Movement of the secondary arm 30 between the solid position and the broken line position to the left of the drawing, is controlled by the piston cylinder tensioning mechanism 38 which is pivotly connected to one end at the support stand or station 39 beside the driving drum 12 and pivotally connected at its other end to the secondary arm 30.

The center wind assist mechanism of the present invention is shown generally at 32. This mechanism comprises drive assist support arm 42 mounted to the secondary arm 30. The support arm 42 is pivotally connected about shaft 34. It should be understood that shaft 34 is co-axial or axially aligned with the rotating shaft 44 of the secondary arm 30. The drive assist support arm 42 includes two linkage arms 46 and 48. As shown in FIG. 1, the drive assist support arm 42 is curved through the pivotal connection between linkages 46 and 48. Arms 46 and 48 are pivotally connected by a shaft member 50 which passes there through and terminates in a pin member 52 (FIG. 2) mounted within a recess 54 of the secondary support arm 30. The curvature in the secondary arm 42 allows for a tire or driving wheel mechanism 56 to contact the peripheral portion or a hub 60 of the reel bar 18 at a location 62 which is below the reel bar hub 60 and offset from the center of rotation of the axis of the reel bar at 64. By being offset, it is meant that the contact portion 62 meets slightly to the right of the vertical line 65 passing through central axis 64 of the reel bar in FIG. 1 at the beginning of the secondary winding position 16 and moves slightly beyond that to the right as shown in the broken lines at 62*a* to the left of the Figure. By having this mechanism slightly off center towards the driving drum 12, the tire mechanism 56 does not add any additional nip pressure to nip 16. It should be understood that the drive mechanisms disclosed are located on both sides of the reel bar and co-operate to center assist drive the reel bar.

The center wind assist mechanism further includes a tensioning means in the form of piston cylinder 70 having one end pivotally connected to the base of the drive assist support arm at 72 and having the other end pivotally connected to the end of the upper linkage arm 48 at 74. The piston cylinder mechanism or tensioning means 70 controls the driving torque relation between the tire 56 and the hub 60 of the reel bar 18 as the secondary support arm and the drive assist support arm move with the winding of the web onto the reel bar.

The center wind assist mechanism 32 of the present invention further includes drive means in the form of an electrical motor 80 for rotatably driving through transmission means in the form of clutch 82, shaft 84, pulley 86, belt 88, dual groove pulley 90, and second drive belt 92 (see FIG. 2) and drive shaft 94 of the tire 56. It should be understood that the motor 80 is torque controlled so as to control the tension on the web through the tire.

The present invention provides a novel construction for a center wind assist mechanism that provides for good driving torque engagement of the reel bar at the ends of the reel bar through the use of a driving wheel or tire. Furthermore, of the placement of the tire beneath the driving hub and off the center of axis rotation of the driving hub towards the driving drum further insures that besides providing a center assist drive additional nip pressure is not induced at nip 16. Accordingly, this will result in the possibility of less paper being crimpled during the wind up procedure especially the initial stages of the wind up procedure. This problem is more acute in the use of recycled fibers in the web being rolled.

What is claimed is:

1. A web winding device for winding a substantially continuous web onto a reel bar having a center axis about which the reel bar rotates, the winding device including:

a) a driving drum maintaining a first nip engagement with the reel bar to rotate the reel bar and transfer the web passing over a surface of the driving drum onto the reel bar;

b) a secondary arm for engaging the reel bar to maintain the reel bar in nip driving engagement with the driving drum, the secondary arm having a base and being pivotally movable about the base to move and maintain the nip driving engagement as the web is wound onto the reel bar, and, c) a center wind assist mechanism comprising (i) a drive assist support arm mounted to the secondary arm to move therewith, (ii) a driving wheel rotatably connected to one end of the drive assist support arm, (iii) tensioning means connected to the drive assist support arm to maintain the driving wheel in driving and torque transfer relation with a peripheral surface portion of the reel bar, which peripheral surface portion is located on one side of and adjacent to a vertical line passing through the center axis of the reel bar, said one side being closest to the driving drum; and, (iv) center assist drive means for rotatably driving the driving wheel.

2. The web winding device of claim 1 wherein the drive assist support arm has a base end remote from the one end to which the driving wheel is rotatably attached, the base end is pivotally connected to a shaft axially aligned with the pivotal axis of the secondary support arm, the drive assist support arm further including an intermediate location between the base end and an end of the drive assist support arm which is connected to the secondary arm such that the drive assist support arm pivots about the shaft as the secondary arm pivots about the shaft as the web is wound onto the reel bar.

3. The web winding device of claim 2 wherein the drive assist support arm includes a pin at the intermediate location that fits into a recess on the secondary arm.

4. The web winding device of claim 1 wherein the drive assist support arm is curved such that the drive assist support arm extends from the base end in a direction parallel to an elongated portion of the secondary arm and then curves at an angle to position the driving wheel below the reel bar.

5. The web winding device of claim 1 wherein the drive assist support arm comprises two linkage arms pivotally connected to each other at an intermediate point, the drive assist support arm being connected with the secondary arm at the intermediate point such that the drive assist support arm pivots about a pivotal axis axially aligned with the pivotal axis of the secondary arm so that the drive assist arm moves with the secondary arm as the secondary arm moves away from the driving drum as the web is wound onto the reel bar.

6. The web winding device of claim 5 wherein the drive assist support arm includes a pin at the intermediate point that fits into a recess on the secondary arm.

7. The web winding device of claim 5 wherein the tensioning means of the center wind assist mechanism includes piston and cylinder memos for pivotally interconnecting the base end of the drive assist support arm at a bottom of the first linkage arm to an end of the drive assist support arm rotatably that supports the driving wheel.

8. The web winding device of claim 7 wherein the driving wheel is a tire.

9. The web winding device of claim 7 wherein the drive means of the center wind assist mechanism includes an electric motor having a shaft coupled to a transmission means for translating motion from the electric motor to the driving wheel, the transmission means includes a first belt passing about the shaft of the motor and a first pulley at the intermediate point, and a second belt passing about the first pulley at the intermediate point and a second pulley having a shaft coupled to the driving wheel whereby the electric motor drives the driving wheel through the first and second belts and the first and second pulleys.

10. The web winding device of claim 1 wherein the secondary arm has a cam wheel located at an end opposite to the base end for engaging a periphery surface portion of the reel bar to hold the reel bar against the driving drum.

11. The web winding device of claim 10 wherein the secondary arm includes a piston and cylinder pivotally connected at one end to the secondary arm and connected at the other end to a station adjacent the driving drum, the piston and cylinder effecting movement of the secondary arm so as to maintain the cam wheel in second nip pressure contact with the periphery surface portion of the reel bar.

* * * * *